US005345994A

United States Patent [19]

Kato et al.

[11] Patent Number: 5,345,994

[45] Date of Patent: Sep. 13, 1994

[54] CASTING METAL STRIP

[75] Inventors: Heiji Kato, Yokasuka, Japan; John Freeman, Kahibah, Australia

[73] Assignees: Ishikawajima-Harima Heavy Industries Company Limited, Tokyo, Japan; John Lysaght (Australia) Limited, Sydney, Australia

[21] Appl. No.: 18,533

[22] Filed: Feb. 17, 1993

[30] Foreign Application Priority Data

Apr. 24, 1992 [AU] Australia ..... PL2089

[51] Int. Cl.[5] ..... B22D 11/06; B22D 11/10

[52] U.S. Cl. ..... 164/480; 164/428; 164/437; 164/488; 222/606

[58] Field of Search ..... 164/480, 428, 488, 489, 164/437; 222/494, 606, 607

[56] References Cited

U.S. PATENT DOCUMENTS 4,865,115 9/1989 Hirata et al. ..... 164/428

5,238,050 8/1993 Folder et al. ..... 164/480

*Primary Examiner*—Kuang Y. Lin

*Attorney, Agent, or Firm*—Nikaido, Marmelstein, Murray & Oram

[57] ABSTRACT

Method and apparatus for casting metal strip in which molten metal is introduced between a pair of parallel casting rollers via a tundish and a metal delivery nozzle. Casting rollers are cooled so that shells solidify on the moving roller surfaces and are brought together at the nip between them to produce a solidified strip product at the roller outlet. The delivery nozzle comprises an elongate trough to receive molten metal and an outlet slot extending longitudinally along the bottom of the trough. The floor of the delivery nozzle is formed with an upwardly facing channel extending longitudinally of the trough in side by side relationship with the outlet slot. The channel merges smoothly at one of its sides with a side wall of the trough and rises at the other side above the root of the channel to the outlet slot. The side wall of the trough is disposed at an acute angle to the vertical and molten metal is supplied in free falling streams to impinge against and adhere to that side wall to form a sheet which flows smoothly downwards into the channel. The channel may be one of pair of similar channels dispose one to either side of the outlet slot.

14 Claims, 5 Drawing Sheets

CASTING METAL STRIP

TECHNICAL FIELD

This invention relates to the casting of metal strip. It has particular but not exclusive application to the casting of ferrous metal strip.

It is known to cast non-ferrous metals such as aluminium by continuous casting in a twin roll caster. Molten metal is introduced between a pair of contra-rotated horizontal casting rollers which are cooled so that metal shells solidify on the moving roller surfaces and are brought together at the nip between them to produce a solidified strip product at the outlet from the roller nip. The molten metal may be introduced into the nip between the rollers via a tundish and a metal delivery nozzle located beneath the tundish so as to receive a flow of metal from the tundish and to direct it into the nip between the rollers.

Although twin roll casting has been applied with some success to non-ferrous metals which solidify rapidly on cooling, there have been problems in applying the technique to the casting of ferrous metals. One particular problem has been the achievement of even cooling and solidification to allow continuous casting to proceed. This problem is addressed in the invention disclosed in Australian Patent Specification No 72897/91.

It has also been found that when casting ferrous metal strip the importance of obtaining an even flow distribution across the width of the nip is particularly critical and defects can occur due to minor flow fluctuations. The present invention addresses this problem and provides an apparatus and technique whereby a very even flow distribution can be achieved. Although the invention has been developed to overcome a problem which is particularly critical in the casting of ferrous strip it may also be applied to the casting of non-ferrous metals, for example aluminium.

DISCLOSURE OF THIS INVENTION

According to the invention there is provided a method of casting metal strip of the kind in which molten metal is introduced between a pair of parallel casting rollers via a metal delivery nozzle disposed above the nip between the rollers, wherein the delivery nozzle comprises an elongate trough to receive molten metal, the floor of the trough comprises an upwardly facing channel and a nozzle outlet slot extending longitudinally of the trough in side by side relationship, the channel merges smoothly at one of its sides with a side wall of the trough and rises at the other side above the root of the channel to the outlet slot, said side wall of the trough is disposed at an acute angle to the vertical and the molten metal is supplied to the delivery nozzle in one or more free falling streams so as to impinge against and adhere to said side wall of the trough to form a sheet of metal which flows smoothly downwards into the channel.

Preferably, said upwardly facing channel is one of a pair of said such channels in the floor of the trough extending longitudinally of the trough in parallel relationship, one to each side of the outlet slot and defining between them a longitudinally extending crest in the floor rising above the roots of the channels, the outlet slot extending through said crest between the channels.

Preferably further, the side walls of the trough converge downwardly so as each to be disposed at an acute angle to the vertical and merge smoothly with the outer sides of the channels, and the molten metal is supplied in two laterally spaced arrays of freely falling streams such that the streams of one array impinge against and adhere to one of the side walls of the trough and the streams of the other array impinge against and adhere to the other of the side walls of the trough.

Preferably too, a pool of molten metal is formed above the nip between the rollers and the nozzle outlet slot extends beneath the surface of that pool.

Preferably further, the molten metal is supplied to the delivery nozzle so as to form a head of molten metal in the trough of the delivery nozzle to a height above the trough floor crest.

The invention also provides an apparatus for casting metal strip comprising a pair of parallel casting rollers forming a nip between them and a metal delivery nozzle for delivering molten metal into the nip between the casting rollers, wherein the metal delivery nozzle comprises an elongate trough to receive molten metal, the floor of the trough comprises an upwardly facing channel and a nozzle outlet slot extending longitudinally of the trough in side by side relationship, the channel merges smoothly at one of its sides with a side wall of the trough and rises at its other side above the root of the channel to the outlet slot, said side wall of the trough is disposed at an acute angle to the vertical and the apparatus further comprises molten metal supply means to supply molten metal to the delivery nozzle in one or more falling streams so as to impinge against the side wall of the trough.

Preferably, said upwardly facing channel is one of a pair of said such channels in the floor of the trough extending longitudinally of the trough in parallel relationship, one to each side of the outlet slot and defining between them a longitudinally extending crest in the floor rising above the roots of the channels, the outlet slot extending through said crest between the channels.

Preferably, each channel has a smoothly curved root. For example, the root may be cylindrically curved.

The crest may have a flat top in the form of a land and the outlet slot may be located centrally of the land.

The molten metal supply means may comprise a tundish having a plurality of flow outlets to supply molten metal to the delivery nozzle in a series of falling streams.

Preferably, the flow outlets of the tundish are disposed in a linear array extending longitudinally of the tundish above the or each channel.

Preferably, where the apparatus comprises the pair of channels, the flow outlets of the tundish are disposed in two linear arrays and the outlets of one array are staggered with respect to the outlets of the other array.

BRIEF DESCRIPTION OF THE DRAWINGS

In order that the invention may be more fully explained, several embodiments will be described in detail with reference to the accompanying drawings in which.

BEST MODES OF CARRYING OUT THE INVENTION

Figure 1:
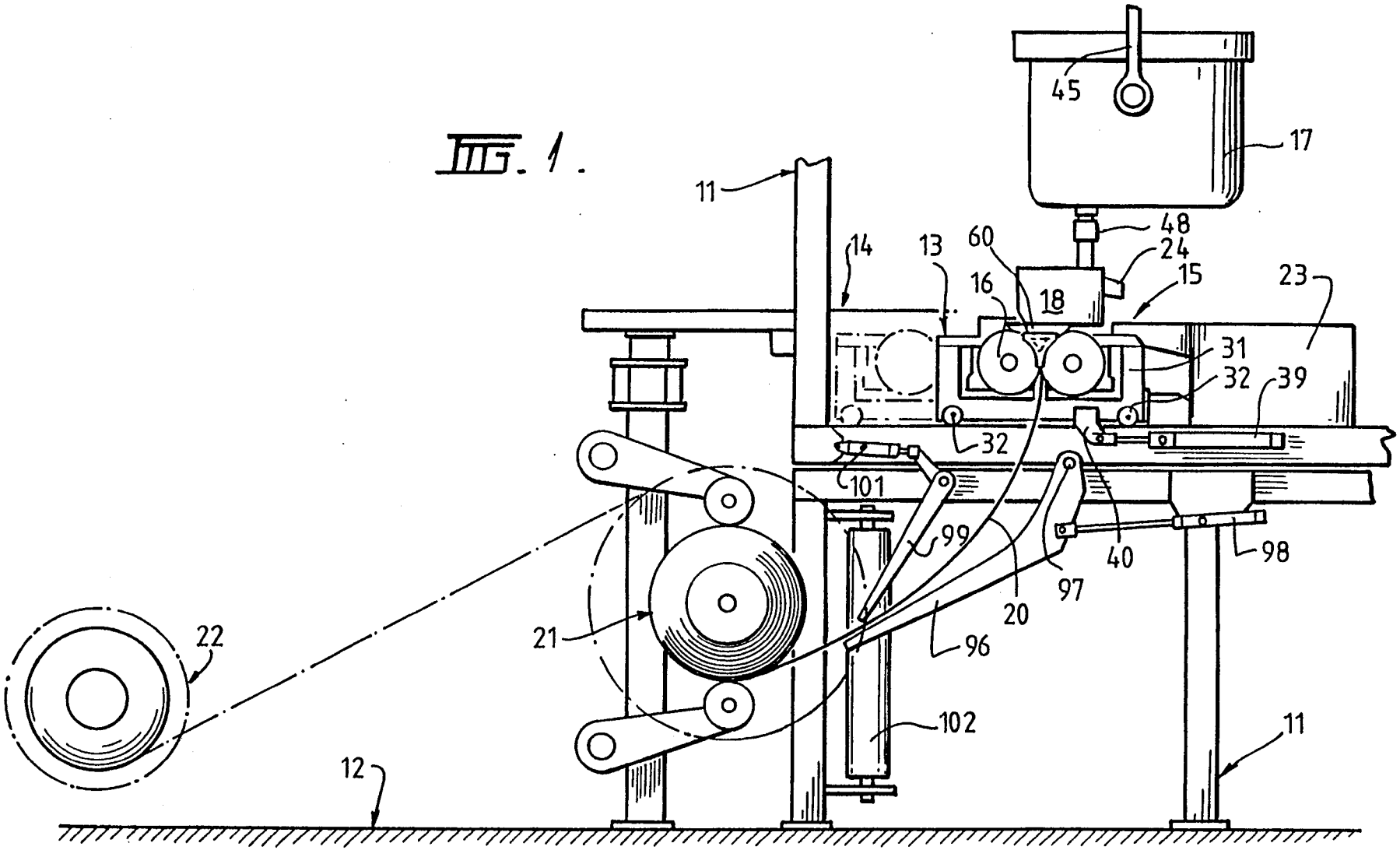
FIG. 1 illustrates a continuous strip caster incorporating apparatus constructed and operating in accordance with the present invention.
Figure 2:
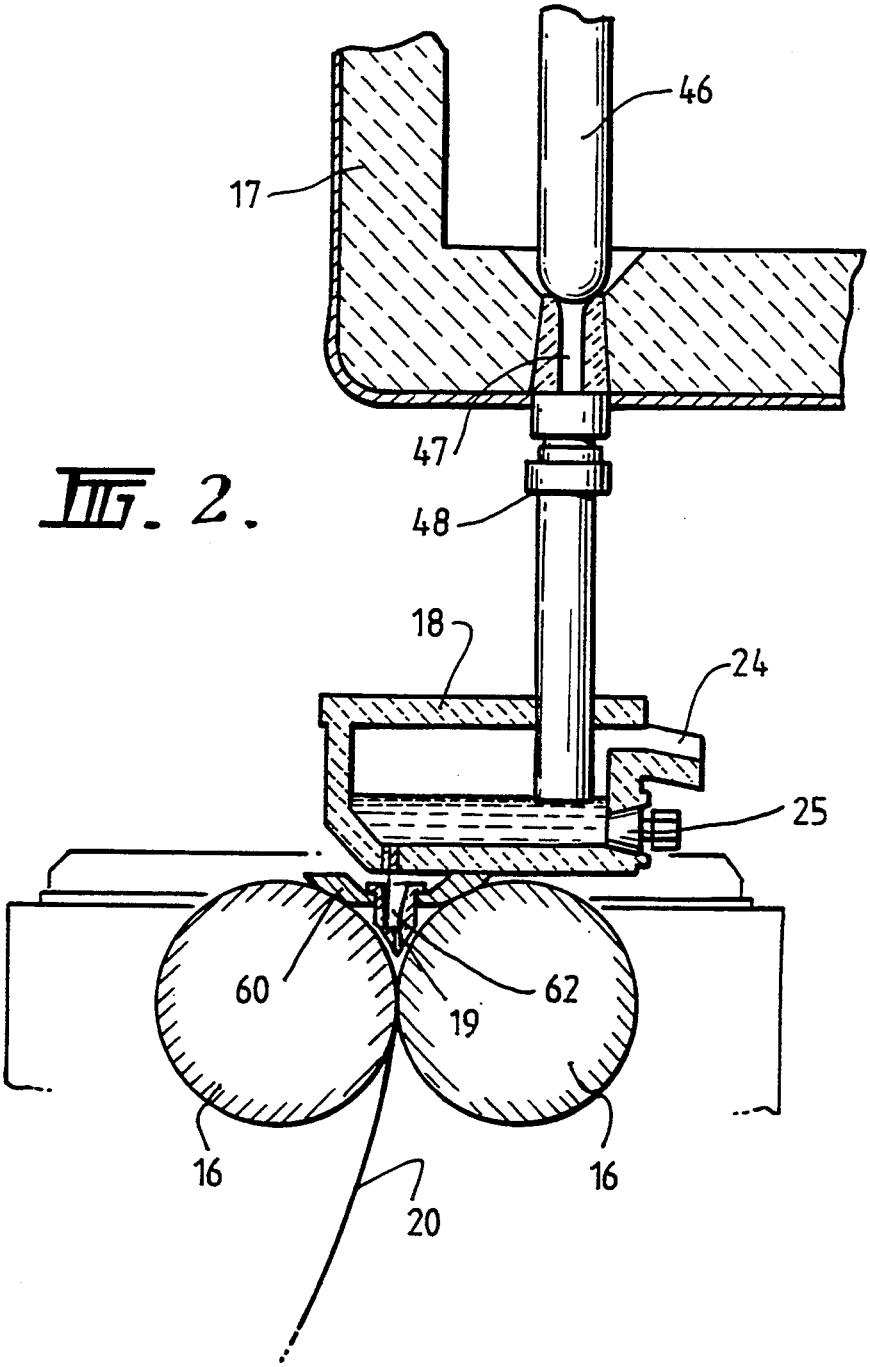
FIG. 2 is a vertical cross-section through important components of the caster illustrated in FIG. 1, including a metal delivery nozzle constructed in accordance with one particular embodiment of the invention.
Figure 3:
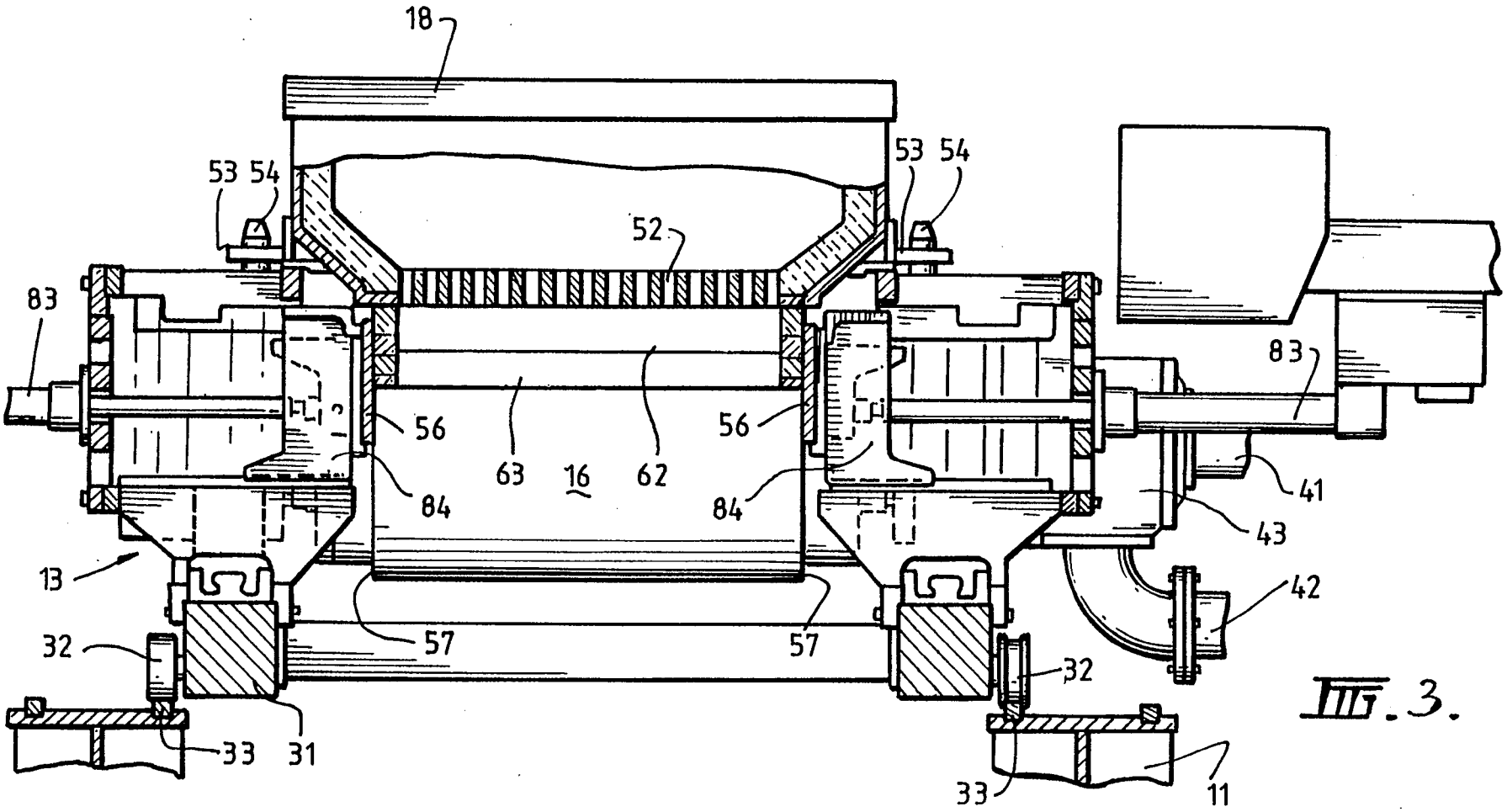
FIG. 3 is a further vertical cross-section through important components of the caster taken transverse to the section of FIG. 2.
Figure 4:
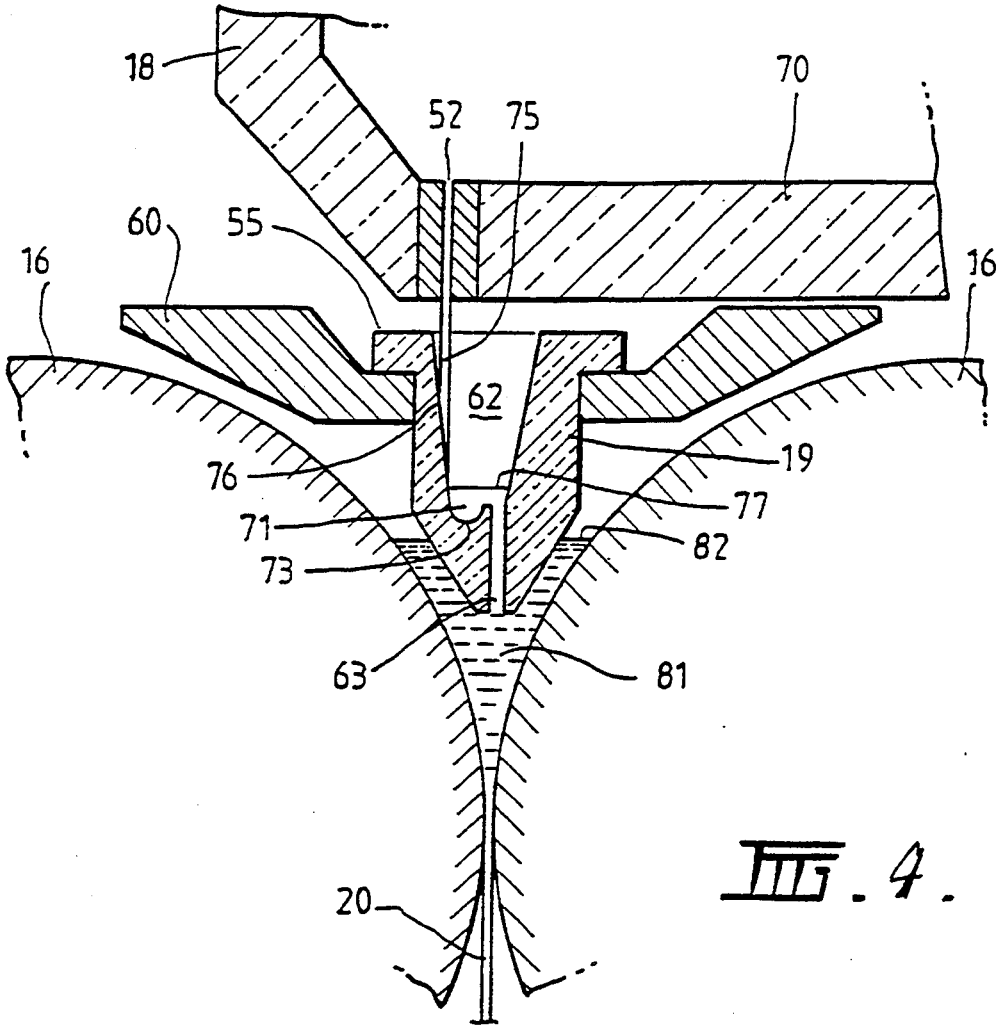
FIG. 4 is an enlarged transverse cross-section through the metal delivery nozzle shown in FIG. 2.
Figure 5:
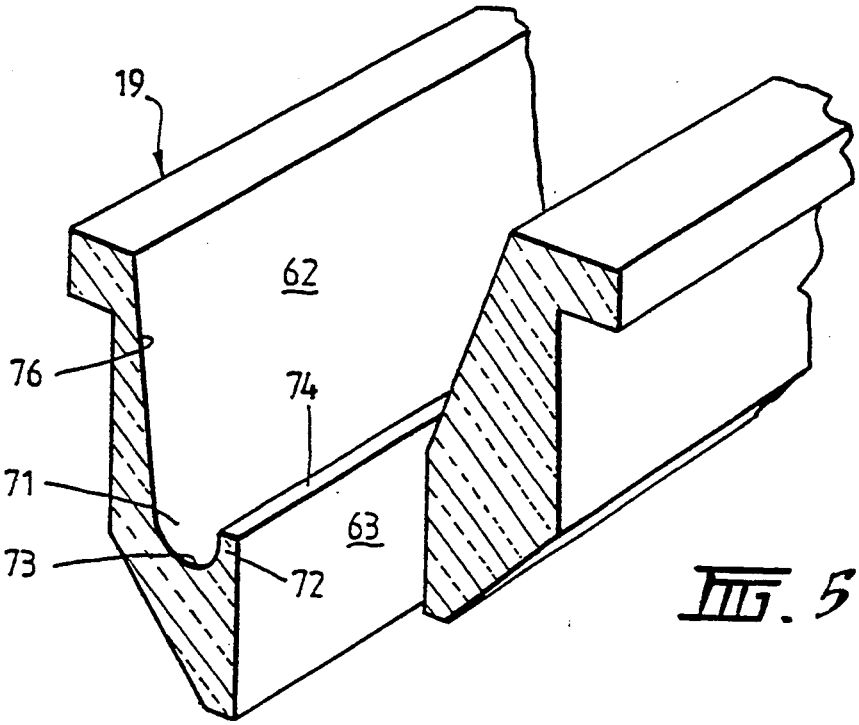
FIG. 5 is a broken away perspective view of the delivery nozzle shown in FIG. 4.

The caster illustrated in FIGS. 1 to 5 comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles in which the rollers 16 are rotatably mounted. Carriage 13 is movable along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and visa versa.

Casting rollers 16 are contra rotated through drive shafts 41 from an electric motor and transmission mounted on carriage frame 31. Rollers 16 having copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The rollers may typically be about 500 mm diameter and up to 1300 mm long in order to produce 1300 mm wide strip product.

Ladle 17 is of entirely conventional construction and is supported via a yoke 45 on an overhead crane whence it can be brought into position from a molten metal receiving station. The ladle is fitted with a stopper rod 46 actuable by a servo cylinder to allow molten metal to flow from the ladle through an outlet nozzle 47 and refractory shroud 48 into tundish 18.

Tundish 18 is formed as a wide dish made of a refractory material such as magnesium oxide (MgO). One side of the tundish receives molten metal from the ladle and is provided with the aforesaid overflow 24 and emergency plug 25. The other side of the tundish is provided with metal outlet openings 52 to be described in more detail below. The lower part of the tundish carries mounting brackets 53 for mounting the tundish onto the roller carriage frame 31 and provided with apertures to receive indexing pegs 54 on the carriage frame so as accurately to locate the tundish.

Delivery nozzle 19 is formed as an elongate body made of a refractory material such as alumina graphite. Its lower part is tapered so as to converge inwardly and downwardly so that it can project into the nip between casting rollers 16. A mounting bracket 60 is provided to support the nozzle on the roller carriage frame and the upper part of the nozzle is formed with outwardly projecting side flanges 55 which locate on the mounting bracket.

Delivery nozzle 19 has an internal vertically extending trough 62 to receive liquid flowing downwardly through the openings 52 of the tundish and the floor of the trough is provided with an elongate outlet slot 63 which extends longitudinally of the nip between the casting rollers.

In accordance with one particular embodiment of the delivery nozzle 19 of the present invention the floor of trough 62 is formed with an upwardly facing channel 71 extending longitudinally of the trough in side by side relationship with the outlet slot 63. Channel 71 merges smoothly at one of its sides with the side wall 76 of the trough and rises at the other side above the root 73 of the channel to the outlet slot 63. The root 73 of the channel 71 is smoothly curved. More particularly, the channel 71 may be generally cylindrically curved. A crest 72 formed between the channel and the outlet slot has a flat top in the form of a land 74.

The side wall 76 of the trough which merges with the channel 71 converges downwardly and is disposed at least partly below the metal outlet openings 52 (arranged in a linear array) of the tundish. As is described hereinafter the angle of inclination of the side wall 76 is selected so that metal tends to adhere to the side wall 76.

In operation of the illustrated apparatus, molten metal from the tundish falls into the trough 62 of delivery nozzle 19 in falling streams 75 emanating from the tundish outlets 52. At least the outermost parts of the streams 75 impinge against the side wall 76 and adhere thereto with the result that the molten metal forms a sheet of metal which flows smoothly downwards into the channel 71 and then through the outlet slot 63 into the nip between the rollers 16. The molten metal delivered from the delivery nozzle forms a pool 81 above the nip between the rollers, this pool being confined at the ends of the rollers by a pair of side closure plates 56 which are held against stepped ends 57 of the rollers by actuation of a pair of hydraulic cylinder units 83 fitted with closure plate holders 84. The upper surface 82 of pool 81, generally referred to as the "meniscus level", rises above the lower end of the delivery nozzle. Accordingly, the lower end of the delivery nozzle is immersed within this pool and the nozzle outlet passage extends below the surface of the pool or meniscus level. The flow of metal is also such as to produce a head or pool of molten metal in the trough 62 of the delivery nozzle to a height above the meniscus level 82. The pool of metal in the lower part of the trough may extend to an upper surface 77 spaced above the crest 72 in the floor of the trough. The molten metal sheet therefore flows initially into relatively deep parts of the pool and the outlet slot 63 is exposed to a relatively static upper central part of the pool. The curved channel 71 ensures that moving metal tends to be directed upwardly and has minimum lateral velocity at the entry to the outlet slot 63. Metal therefore flows into slot 63 with minimum turbulence and a steady relatively slow stream.

In a typical ferrous metal caster constructed in accordance with the invention, the width of the slot outlet from the nozzle may be in the range 1 mm to 5 mm, for example, around 1.5 mm. The channels 71 may be approximately 15 mm wide and 7.5 mm deep and curved to about 7.5 mm radius. The tundish outlet openings 52 may be 8 mm in diameter and arranged at about 50 mm spacing. During a casting run the head of metal formed in the bottom part of the delivery nozzle trough may typically be about 20 mm above the meniscus level 82.

Figure 6:
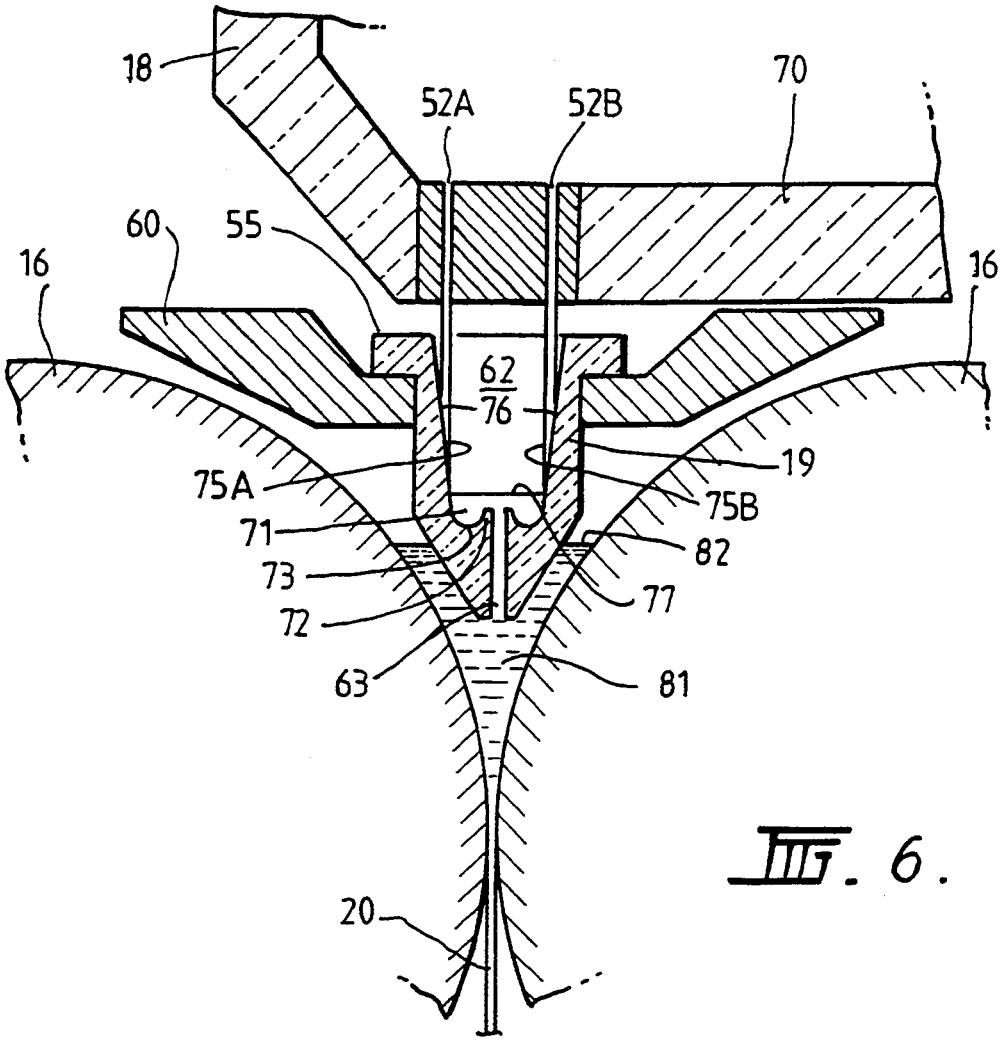
FIG. 6 is an enlarged transverse cross-section through a metal delivery nozzle constructed in accordance with another particular embodiment of the invention.
Figure 7:
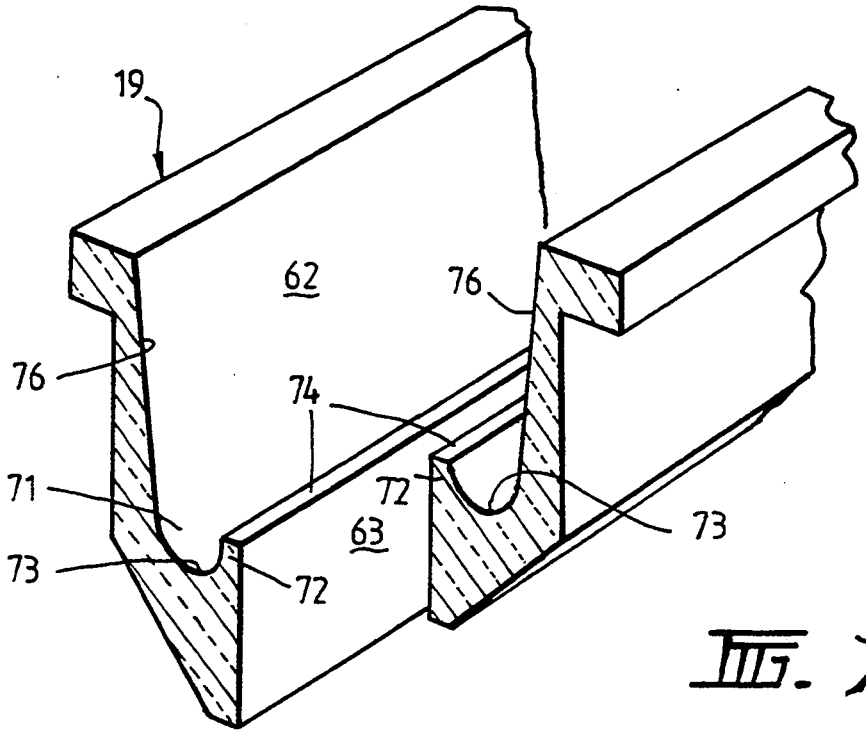
FIG. 7 is a broken away perspective view of the delivery nozzle shown in FIG. 6.

In accordance with the other particular embodiment of the delivery nozzle 19 of the present invention illustrated in FIGS. 6 and 7 the floor of trough 62 is formed with a pair of upwardly facing channels 71 extending longitudinally of the trough in parallel relationship one to each side of the outlet slot 63 and opposed side walls 76 which converge downwardly and merge with the channels 71. Between channels 71 there is defined the longitudinally extending crest 72. The roots of the channels 71 are smoothly curved. More particularly, the channels 71 may be cylindrically curved. Crest 72 has a flat top in the form of a land 74 and the outlet slot 63 is located centrally of the land 74.

The metal outlet openings 52 of the tundish are disposed in two linear arrays of openings 52A, 52B extending longitudinally of the tundish one at least partly above each of the side walls 76 of the nozzle trough 62. The outlet openings 52A of one array are staggered longitudinally of the trough with respect to the outlet openings 52B of the other array.

In operation of the illustrated apparatus in FIGS. 6 and 7, molten metal from the tundish falls into the trough 62 of delivery nozzle 19 in two sets of falling streams 75A, 75B emanating from the tundish outlet openings 52A, 52B. At least the outermost parts of the streams 75A, 75B impinge against the side walls 76 and adhere thereto with the result that the molten metal forms sheets of metal which flow smoothly downwards into the channels 71.

Similarly to the apparatus shown in FIGS. 1 to 5, during a casting run molten metal delivered from the delivery nozzle forms a pool 81 above the nip between the rollers, this pool being confined at the ends of the rollers by a pair of side closure plates 56 which are held against stepped ends 57 of the rollers by actuation of a pair of hydraulic cylinder units 83 fitted with closure plate holders 84. The upper surface 82 of pool 81, generally referred to as the "meniscus level", rises above the lower end of the delivery nozzle. Accordingly, the lower end of the delivery nozzle is immersed within this pool and the nozzle outlet passage extends below the surface of the pool or meniscus level. The flow of metal is also such as to produce a head or pool of molten metal in the trough 62 of the delivery nozzle to a height above the meniscus level 82. The pool of metal in the lower part of the trough may extend to an upper surface 77 spaced above the crest 72 in the floor of the trough. The molten metal sheets therefore flow into relatively deep parts of the pool and the outlet slot 63 is exposed to a relatively static upper central part of the pool. The curved channels 71 ensure that moving metal tends to be directed upwardly towards the central part of the pool with minimum lateral velocity at the entry to the outlet slot 63. Metal therefore flows into slot 63 with minimum turbulence and a steady relatively slow stream.

The embodiment of the delivery nozzle 19 shown in FIGS. 6 and 7 has the unexpected advantage that the width of the slot outlet 63 can be up to 10 mm, which is considerably wider than that possible with the embodiment shown in FIGS. 1 to 5, without loss of product quality. The relatively wide outlet slot 63 is an advantage from the viewpoint of minimising clogging of the outlet nozzle 63.

Many modifications may be made to the preferred embodiments of the present invention without departing from the spirit and scope of the present invention.

By way of example, the channels 71 may comprise walls extending transversely of the trough in parallel relationship to divide the channels into a series of compartments to minimise flow of molten metal longitudinally of the trough. The transverse walls may be positioned so that the streams 75, 75A, 75B fall into the compartments mid-way between the transverse walls.

We claim:

1. Apparatus for casting metal strip comprising a pair of parallel casting rollers forming a nip between them and a metal delivery nozzle for delivering molten metal into the nip between the casting rollers, wherein the metal delivery nozzle comprises an elongate trough to receive molten metal, the floor of the trough comprises an upwardly facing channel and a nozzle outlet slot extending longitudinally of the trough in side by side relationship, the channel merges smoothly at one of its sides with a side wall of the trough and rises at its other side above the root of the channel to the outlet slot, said side wall of the trough is disposed at an acute angle to the vertical and the apparatus further comprises molten metal supply means to supply molten metal to the delivery nozzle in one or more falling streams so as to impinge against the side wall of the trough.

2. Apparatus as claimed in claim 1, wherein the molten metal supply means comprise a tundish having a plurality of flow outlets to supply molten metal to the delivery nozzle in a series of falling streams spaced along said side wall of the trough.

3. Apparatus as claimed in claim 2, wherein said upwardly facing channel is one of a pair of said such channels in the floor of the trough extending longitudinally of the trough in parallel relationship, one to each side of the outlet slot and defining between them a longitudinally extending crest in the floor rising above the roots of the channels, the outlet slot extending through said crest between the channels.

4. Apparatus as claimed in claim 3, wherein each channel has a smoothly curved root.

5. Apparatus as claimed in claim 3, wherein the root of each channel is cylindrically curved.

6. Apparatus as claimed in claim 3, wherein said crest has a flat top in the form of a land and the outlet slot is located centrally of the land.

7. Apparatus as claimed in claim 3, wherein the side walls of the trough converge downwardly so as each to be disposed at an acute angle to the vertical and merge smoothly with the outer sides of the channels, and the tundish has flow outlets disposed in two linear arrays extending longitudinally of the trough and one above each of the side walls of the trough.

8. Apparatus as claimed in claim 7, wherein the outlets of one array are staggered with respect to the outlets of the other array.

9. A method of casting metal strip from a pair of parallel casting rollers defining a nip therebetween comprising:

introducing molten metal into a delivery nozzle means disposed above said casting rollers, comprising an elongated trough adapted to receive said molten metal, disposed generally parallel to said nip of said casting rollers, which trough comprises:

an upwardly directed nozzle outlet slot means extending longitudinally of said trough at the floor of said trough;

an upwardly facing channel means at the floor of said trough extending longitudinally of said trough extending generally parallel to, and in side by side arrangement with said slot means, having:

a first channel side wall, directed towards said slot, extending higher than the base of said channel; and a second channel side wall, means directed away from said slot;

a first trough side wall extending smoothly upwardly from side of said nozzle outlet slot means disposed away from said channel means; and a second trough side wall extending upwardly from said second channel side wall means and outwardly in a direction away from said slot means;

impinging said molten metal onto said second trough side wall thereby forming a sheet of molten metal adhering to and flowing smoothly down said second trough side wall, said second channel side wall means, and thence into said channel means in an amount sufficient to overfill said channel means; and causing said molten metal to overflow said first channel side wall, between said channel and said slot, and thence to flow into said slot.

10. The method as claimed in claim 9 including forming a pool of molten metal in said nip and flowing said molten metal from said slot into said pool below the surface thereof.

11. The method as claimed in claim 9 wherein said trough comprises two channel means, one to either side of said slot means, each of which comprises a first channel side wall means disposed toward said slot and a second channel side wall means disposed away from said slot, and wherein said first and second trough side wall means extend upwardly and outwardly from said second channel side walls means in a direction away from said slot means; and including flowing molten metal onto both of said trough side walls means, onto said second channel side walls means, into both of said channel means, overflowing both of said first channel side walls means, and then flowing into said slot.

12. The method as claimed in claim 11 including impinging molten metal streams onto each of said trough side walls means from separate sources thereof.

13. The method as claimed in claim 12 wherein said streams are spaced longitudinally of said trough and wherein each of said streams is staggered longitudinally of said trough with respect to the other of said streams.

14. The method as claimed in claim 12 including providing sufficient molten metal in said channel to maintain a head of metal higher than the height of said first channel walls means.

* * * * *